US005292712A

United States Patent [19]

Klug et al.

[11] Patent Number: 5,292,712

[45] Date of Patent: Mar. 8, 1994

[54] THERMOREACTIVE RECORDING MATERIAL HAVING PARTICULAR STABILITY

[75] Inventors: Günter Klug, Monheim; Heinrich Schrage, Krefeld; Pieter Ooms, Krefeld; Hans-Josef Buysch, Krefeld, all of Fed. Rep. of Germany

[73] Assignee: Bayer Aktiengesellschaft, Leverkusen, Fed. Rep. of Germany

[21] Appl. No.: 916,938

[22] Filed: Jul. 20, 1992

[30] Foreign Application Priority Data

Jul. 30, 1991 [DE] Fed. Rep. of Germany ..... 4125118

[51] Int. Cl.[5] ..... B41M 5/28

[52] U.S. Cl. ..... 503/209; 427/150; 503/216; 503/225

[58] Field of Search ..... 503/200, 209, 216, 208, 503/225; 427/150–152

[56] References Cited

PUBLICATIONS

Japanese Abstracts, JP 8005-288; JP 59,209,192 and JP57045-093.

Patent Abstracts of Japan, vol. 11, No. 218, Jul. 15, 1987.

Patent Abstracts of Japan, vol. 13, No. 593, Dec. 27, 1989.

Patent Abstracts of Japan, vol. 9, No. 80, Apr. 10, 1985.

Patent Abstracts of Japan, vol. 6, No. 117, Jun. 30, 1982.

*Primary Examiner*—Pamela R. Schwartz

*Attorney, Agent, or Firm*—Sprung Horn Kramer & Woods

[57] ABSTRACT

New thermoreactive recording materials contain at least one salt of a specially modified bisphenolcarboxylic acid and are distinguished by good stabilisation of the ink, even upon extended storage time, good light stabilities and excellent stabilities to water, plasticisers, fats and substances contained in text-marking pens.

10 Claims, No Drawings

THERMOREACTIVE RECORDING MATERIAL HAVING PARTICULAR STABILITY

The present relates to a thermoreactive recording material comprising a support material, dyestuff formers, salts of carboxylic acids and, if desired, acid developers.

It is known to prepare thermoreactive recording materials by first preparing the following aqueous dispersions:

a) a dispersion containing at least one colourless or weakly coloured dyestuff former, b) a dispersion containing at least one acid developer and, if desired, c) a dispersion containing at least one sensitiser and, if desired, further additives, mixing these dispersions, applying the dispersion mixture to a support material, for example to paper or a plastic sheet, and drying.

If desired, dispersions b) and c) can be prepared as a joint dispersion. It is also possible not to mix the individual dispersions but to apply them in succession to a support material.

The support material can be used as such or in pretreated, for example precoated, form. Such a precoating is capable of conditioning the support material in any desired manner, for example with respect to smoothness, absorbency and/or reflectivity.

In the thermoreactive layer, images or information items are produced by colour formation by means of thermal energy, for example by means of a thermohead. Such systems are described, inter alia, in JP-A2-57/191,089, 58/205,793, 58/205,795, 58/209,592, 58/211,494, 58/098,285, 58/289,591, 58/211,493 and 59/9,092, and in German Offenlegungsschrift 3,242,262, EP-A 173,232 and U.S. Pat. No. 4,713,364.

Such heat-sensitive recording materials can be used, for example, as thermopapers in computer printers, ticket machines, label printers, in recorders of, for example, medicinal measuring instruments and in telefax (thermofax) machines. A great disadvantage of the known heat-sensitive recording materials is the lack of stability of the images produced to fats and plasticisers.

Stability to such influences is of particular importance in the case of labels for foodstuffs, in storing medical information and in information received via a telefax. For example, upon contact with fats or plasticisers, as are possibly present in plastic covers in which the printouts in question are sorted and stored, the images and information in the thermosensitive layer fade or disappear almost completely in the course of time. It is true that fading or disappearance of the images and information can be delayed or prevented by coating the thermosensitive layer with certain materials (see, for example, German Offenlegungsschrift 3,828,731 and GB-A 2,122,363), but this overcoating reduces the sensitivity of the thermosensitive recording material to such an extent that it can no longer be used or can only be used with a high loss of intensity of the images and information in high-speed telefax machines, which require thermopapers of increased sensitivity. Moreover, subsequent coating is a cost-intensive process.

JP-A2-58/005,288, JP-A2-59/209,192 and JP-A2-57/045,093 describe bisphenolcarboxylic acids and esters thereof as developers which are said to contribute to improving the stability of thermosensitive recording material to fats and plasticisers. However, their effect is either weak or associated with unsatisfactory shelf life leading to extensive greying of the otherwise mostly white thermosensitive recording material.

U.S. Pat. No. 3,565,848 describes salts of modified bisphenolcarboxylic acids which serve for improving the stability of phenolic resins used in moulding compositions, moulds and abrasive materials (for example grinding stones). EP-A 0,218,810, EP-A 0,271,081 and German Offenlegungsschrift 2,724,107 describe the use of metal salts of substituted salicylic acids in recording materials. Their disadvantage is that when used in thermosensitive layers, their whiteness is unsatisfactory in combination with a very poor shelf life.

Accordingly, there is a need for a heat-sensitive recording material having high thermal sensitivity and good stability to fats and plasticisers in combination with high whiteness and good storage stability.

Thermoreactive recording materials have now been found which are characterised in that they contain at least one salt of a modified bisphenolcarboxylic acid of the formula (I)

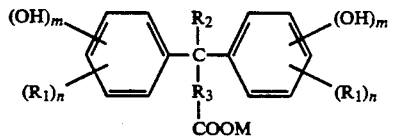

(I)

in which $R_1$ in each case represents, independently of one another, $C_1$- to $C_5$-alkoxy, $C_1$- to $C_6$-alkyl, $C_3$- to $C_6$-cycloalkyl or phenyl, $R_2$ represents hydrogen, $C_1$- to $C_6$-alkyl or phenyl, $R_3$ represents $C_1$- to $C_5$-alkylene or a direct bond, m in each case represents, independently of one another, one or two, n in each case represents, independently of one another, zero, one or two and M represents an equivalent of a polyvalent metal ion, for example an equivalent of $Mg^{2+}$, $Zn^{2+}$, $Ca^{2+}$, $Al^{3+}$, $B^{3+}$, $Pb^{2+}$ or $Ti^{4+}$.

Examples of compounds of the formula (I) are those in which $R_1$ in each case represents, independently of one another, ethoxy, methoxy, i-propoxy, butoxy, pentoxy, methyl, ethyl, propyl, butyl, i-propyl, pentyl, cyclopropyl, cyclobutyl, cyclopentyl, cyclohexyl or phenyl, $R_2$ represents hydrogen, methyl, ethyl, propyl, butyl, 2-propyl, 1-pentyl, 2-pentyl, 1-hexyl, i-butyl or phenyl, $R_3$ represents methylene, 1,1-ethylene, 1,2-ethylene, 1,1-propylene, 1,2-propylene, 1,3-propylene, 2,2-propylene, 1,1-butylene, 1,2-butylene, 1,3-butylene, 1,4-butylene, 2,2-butylene, 2,3-butylene or a direct bond and m, n and M have the abovementioned meaning.

Preference is given to compounds of the formula (I) in which $R_1$ in each case represents, independently of one another, ethoxy, methoxy, i-propoxy, butoxy, pentoxy, methyl, ethyl, propyl, butyl, i-propyl, pentyl, cyclopropyl, cyclopentyl, cyclohexyl or phenyl, $R_2$ represents hydrogen, methyl, ethyl, propyl, butyl, 2-propyl, pentyl, hexyl, i-butyl or phenyl, $R_3$ represents methylene, 1,1-ethylene, 1,2-ethylene, 1,1-propylene, 1,2-propylene, 1,3-propylene, 1,1-butylene, 1,2-butylene, 1,3-butylene, 1,4-butylene, 2,2-butylene, 2,3-butylene or a direct bond and M represents an equivalent of $Mg^{2+}$, $Zn^{2+}$, $Ca^{2+}$, $Al^{3+}$, $B^{3+}$ or $Pb^{2+}$ and m and n have the abovementioned meanings.

Particular preference is given to compounds of the formula (I) in which $R_1$ in each case represents, independently of one another, ethoxy, methoxy, i-propoxy, butoxy, methyl, ethyl, propyl, butyl, i-propyl, pentyl, cyclopentyl, cyclohexyl or phenyl, $R_2$ represents hydrogen, methyl, ethyl, propyl, butyl, 2-propyl, pentyl, hexyl or phenyl, $R_3$ represents methylene, 1,1-ethylene, 1,2-ethylene, 1,1-propylene, 1,2-propylene, 1,3-propylene, 1,1-butylene, 1,2-butylene, 1,3-butylene, 1,4-butylene, 2,2-butylene or a direct bond, m represents one, M represents an equivalent of $Mg^{2+}$, $Zn^{2+}$ or $Ca^{2+}$ and n has the abovementioned meaning.

Preference is given to salts of modified biphenolcarboxylic acids of the formula (I) of symmetrical structure, i.e. those compounds of the formula (I) in which both radicals $R_1$ are identical, both numbers m are identical, both numbers n are identical and the OH and $R_1$ groups in both aromatic rings are in the same positions.

Further preference is given to compounds of the formula (I) in which $R_1$ represents hydrogen, methyl or tert.-butyl, $R_2$ represents hydrogen or methyl, $R_3$ represents $C_1$- to $C_3$-alkylene or a direct bond, m represents one, n represents zero or one and M represents an equivalent of $Mg^{2+}$, $Zn^{2+}$, $Ca^{2+}$ or $Pb^{2+}$, particularly preferably of $Mg^{2+}$, $Zn^{2+}$ or $Ca^{2+}$.

The salts of the bisphenolcarboxylic acids of the formula (I) can be prepared by processes known per se from the corresponding free bisphenolcarboxylic acids (formula (I) where M is hydrogen), which in turn are available by condensation of the corresponding phenol of the formula (II)

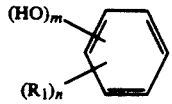

(II)

in which $R_1$, m and n have the meaning given in formula (I), with the corresponding oxocarboxylic acid of the formula (III)

$$R_2-\underset{\underset{O}{\|}}{C}-R_3-COOH \qquad \text{(III)}$$

in which $R_2$ and $R_3$ have the meaning given in formula (I) (see, for example, J. Org. Chem. 23, 1005 (1958); J. Org. Chem. 24, 1949 (1951); J. Org. Chem. 27, 455 (1962) and JACS 76, 4465 (1954)). The free bisphenolcarboxylic acid (formula (I), M is hydrogen) can be converted to the corresponding alkali metal salt (formula (I), M is alkali metal) using an aqueous base, for example an aqueous solution of alkali metal hydroxide, alkali metal carbonate or alkali metal bicarbonate, and precipitated and isolated from an aqueous solution thereof by addition of a soluble salt of the desired polyvalent metal as a salt of the modified bisphenolcarboxylic acid of the formula (I).

According to another process, an oxide or preferably a hydroxide of the desired polyvalent metal can be heated in a stoichiometric ratio with the free bisphenolcarboxylic acid in aqueous solution, if appropriate a salt of a modified bisphenolcarboxylic acid of the formula (I).

For recording materials according to the invention, those salts of modified bisphenolcarboxylic acids of the formula (I) in which the OH groups are either in the para or ortho and para position relative to the $R_2$—C—$R_3$—COOM grouping and $R_1$ is in the meta and/or ortho position relative to the $R_2$—C—$R_3$—COOM grouping are also preferred. Particularly preferably, OH is in the para and $R_1$ in the meta position relative to the $R_2$—C—$R_3$—COOM grouping.

The salts of modified bisphenolcarboxylic acids of the formula (I) can be used in thermoreactive recording materials according to the invention as they are formed in the preparation processes described above, i.e., for example, in purities of 70 to 100% by weight with or without water of crystallisation.

Thermoreactive recording materials according to the invention can contain any desired customary leuco dyestuffs as chromogen. Preference is given to leuco dyestuffs of the triphenylmethane, fluoran, phenothiazine, auramine, spiropyran and indolinophthalide type, each of which can be used by itself or in a combination. Examples of such chromogens are: 3,3-bis-(p-dimethylaminophenyl)-6-dimethylaminophthalide (=crystal violet lactone), 3,3-bis-(p-dimethylamino- phenyl)-6-chlorophthalide, 3-cyclohexylamino-6-chlorofluoran, 3-dimethylamino-5,7-dimethylfluoran, 3-diethyl-amino-7-methylfluoran, 3-(N-p-tolyl-N-ethylamino)-6-methyl-7-anilinofluoran, 2-[3,6-bis-(diethylamino)-9-(o-chloroanilino)-xanthyl]benzoic acid lactam, 3N-methyl-N-cyclohexylamino-6-methyl-7-anilinofluoran, 3-diethyl-amino-6-methyl-7-anilinofluoran, 3-(N,N-diethylamino)-5-methyl-7-(N,N-dibenzylamino)-fluoran, 6'-chloro-8'-methoxy-benzoindolino-spiropyran, 3-(2'-hydroxy-4'-dimethylaminophenyl)-3-(2'-methoxy-5'-nitrophenyl)-phthalide, 3-(2'-methoxy-4'-dimethylaminophenyl)-3-(2'-hydroxy-4'-chloro-5'-methylphenyl) -phthalide, 3-(N-ethyl-N-tetrahydrofurfuryl)-amino-6-methyl-7-anilinofluoran, 3-N-ethyl-N-(2-ethoxypropyl)-amino-6-methyl-7-anilinofluoran, 3-(N-methyl-N-isopropyl)-amino-6-methyl-7-anilinofluoran, 3-morpholino-7-(N-propyl-trifluoromethylanilino)-fluoran, 3-diethylamino-5-chloro-7-(N-benzyl-trifluoromethylanilino)-fluoran, 3-(N-ethyl-p-toluidino)-7-(α-phenylethylamino)-fluoran, 3-diethyl-amino-7-(o-methoxycarbonylphenylamino)-fluoran, 3-diethylamino-5-methyl-7-(α-phenylethylamino)-fluoran, 3-diethylamino-7-piperidinofluoran, 3-dibutylamino-6-methyl-7-anilinofluoran, 3,6-bis-(dimethylamino)-fluorenspiro(9,3')-6-dimethylaminonaphthalide, 3-(N-benzyl-N-cyclohexylamino)-5,6-benzo-7-naphthylamino-4'-bromofluoran, 3-diethylamino-6-chloro-7-anilinofluoran, 3-N-methyl-N-isopropyl-6-methyl-7-anilinofluoran, 3-N-ethyl-N-amyl-6-methyl-7-anilinofluoran and 3-diethylamino-6-methyl-7-(2',4'-dimethylanilino)-fluoran.

Thermoreactive recording materials according to the invention can contain, as colour developers, any desired electron-acceptors or acids customary as colour developers and inducing colour formation of the leuco dyestuff upon application of heat, such as polyphenols, hydroxydiphenyl sulphones, hydroxydiphenyl sulphoxides, hydroxybenzoic esters, esters of bile acids, hydroxydiphenyl sulphides, hydroxydiphenyl disulphides, salicylic acids, esters or amides thereof, hydroxynaphthalenecarboxylic acids, esters or amides thereof, bis-(hydroxyphenylthio)-dioxaalkanes, bis-(hydroxyphenylthio)-oxaalkanes and bis-(hydroxyphenyl)-alkanes.

Examples of such colour developers are: 4,4'-isopropylidenebisphenol, 4,4'-isopropylidenebis (o-methylphenol), 4,4'-sec.-butylidenebisphenol, 4,4'-isopropylidenebis(2-tert.-butylphenol), 4,4'-cyclohexylidenediphenol, 4,4'-isopropylidenebis(2-chlorophenol), 2,2'-methylenebis(4-methyl-6-tert.-butylphenol), 2,2'-methylenebis(4-ethyl-6-tert.-butylphenol), 4,4'-butylidenebis(6-tert.-butyl-2-methyl)-phenol, 1,1,3-tris(2-methyl-4-hydroxy-5-tert.-butylphenyl)-butane, 4,4'-thiobis(6-tert.-butyl-2-methyl)-phenol, bis(p-hydroxy-phenyl) sulphone,4-isopropoxy-4'-hydroxydiphenyl sulphone, 4-benzyloxy-4'-hydroxydiphenyl sulphone, bis(p-hydroxyphenyl) sulphoxide, isopropyl p-hydroxybenzoate, benzyl p-hydroxybenzoate, stearyl gallate, lauryl gallate, octyl gallate, 1,7-bis(4-hydroxyphenylthio)-3,5-dioxaheptane, 1,5-bis(4-hydroxyphenylthio)-3-oxapentane, 1,3-bis(4-hydroxyphenylthio)-propane, 1,3-bis(4-hydroxy- phenylthio)-2-hydroxypropane, N,N'-diphenylthiourea, N,N'-di(m-chlorophenyl)-thiourea, salicylanilide, 5-chloro-salicylanilide, 2-hydroxy-3-naphthoic acid, 2-hydroxy-1-naphthoic acid, 1-hydroxy-2-naphthoic acid, bis(4-hydroxyphenyl)-benzylacetate,3,4-dihydroxyphenyl-4'-methylphenyl sulphone, 1,7-bis-(4-hydroxyphenylthio)-3-dioxaheptane, 1,5-bis-(4-hydroxyphenylthio)-3-oxapentane and 1,4-bis-(4-hydroxyphenylthio)-butane.

The salts to be used according to the invention of modified bisphenolcarboxylic acids of the formula (I) also have certain developer properties. Accordingly, in special cases, the addition of a special colour developer can, if desired, be omitted.

Preferably but not necessarily, thermoreactive recording materials according to the invention contain, in addition to chromogens, colour developers and salts of modified bisphenolcarboxylic acids, so-called sensitisers. These can be customary heat-meltable substances which are capable of accelerating the colour development rate and/or increasing the colour formation. Such sensitisers can, for example, have a melting point in the range from 70° to 140° C., preferably 70° to 130° C. and in particular 75° to 120° C. and originate, for example, from the following classes of compounds: aromatic sulphonamides, carboxamides, anilides, p-hydroxybenzoic esters, p-hydroxyterephthalic esters, diphenyl sulphones, benzyl diphenyls, phenylsalicylic esters, terephthalic diesters, isophthalic diesters and waxes (see also JP-A2-57/191,089, 58/98,285, 58/205,793, 58/205,795, 58/209,591, 58/209,592, 58/211,493, 58/211,494 and 59/9,092.

Examples of sensitisers are: stearylamide, benzenesulphonylanilide, p-benzylbiphenyl, oxalate, dimethyl terephthalate, 1- and 2-benzyloxynaphthalene, ethylene glycol m-tolyl ether, diphenyl carbonate, dibenzyl terephthalate, dibenzyl isophthalate, m-terphenyl, 1,2-diphenoxyethane, benzyl p-hydroxybenzoate and bis-(2-(4-methoxy)-phenyloxyethyl) ether.

Thermoreactive recording materials according to the invention can, if desired, additionally contain binders and/or other customary additives. The binders can be, for example, partially or completely hydrolysed polyvinyl acetate, hydroxyethylcellulose, gum arabic, starch, polyvinylpyrrolidone or casein, and the other additives can be, for example, fillers, surface-active agents, antioxidants and/or antifoams.

Examples of suitable fillers are fine powders of inorganic compounds, such as calcium carbonate, calcium sulphate, silica, titanium oxide, barium sulphate, talcum and surface-treated silica, and fine powders of organic compounds, such as urea, formaldehyde resins, styrene/methacrylic acid copolymers, polystyrene resins and polyacrylic copolymers (see, for example, German Offenlegungsschrift 3,715,724).

Thermoreactive recording materials according to the invention can contain a wide range of support materials. For example, any desired paper is suitable, which may be used untreated or pretreated. Preference is given to those papers usually used for the production of copies on fax machines, labels and tickets, for labelling freight and luggage items and for similar purposes. Examples of pretreated papers can be precoated papers in which the coating can serve, for example, the purpose of applying fillers and/or of influencing the heat conductivity. Pretreatments of this type can have been carried out on one or both sides of the paper. The paper can also have been calendered or smoothed on one or both sides in the paper machine. One side of the paper, preferably the back, can, if desired, also have been provided with plastic material, gelatin, adhesive and/or a release layer. For thermoreactive recording materials according to the invention, papers having a weight per unit area of 20 to 200 g/m$^2$, preferably 30 to 100 g/m$^2$, are, for example, suitable. For thermoreactive recording materials according to the invention, any desired sheets can be used as support materials. Preference is given to those sheets which are usually used as support materials for overhead projection or other presentation systems. Furthermore, the support material used can also be paperboard and cardboard which, if desired can have been coated and/or pretreated as described under paper as support material.

Thermoreactive recording materials according to the invention can contain, for example, 0.1 to 40% by weight of modified bisphenolcarboxylic acids of the formula (I) in the coating (i.e. without taking into account the support material). This amount is preferably 1 to 30% by weight, particularly preferably 5 to 25% by weight. The coating can furthermore contain, for example, 1 to 20% by weight of chromogen. The amount of chromogen is preferably 2 to 15% by weight, particularly preferably 5 to 10% by weight. The coating can furthermore contain, for example, 0 to 30% by weight of colour developer. Of these, amounts of 5 to 25% by weight, in particular those of 10 to 20% by weight, are preferred. Furthermore, the coating can contain sensitisers, for example in an amount of 0 to 30% by weight, preferably 5 to 25% by weight, in particular 10 to 20% by weight. Binders and customary additives can be present in the coating, for example in an amount of 5 to 80% by weight, 20 to 70% by weight, in particular 30 to 60% by weight, being preferred here. The sum of all components of the coating adds up to 100% by weight.

Thermoreactive recording materials according to the invention can be prepared, for example, by first preparing starting dispersions, i.e. a chromogen dispersion, a dispersion containing at least one salt of a modified bisphenolcarboxylic acid of the formula (I) and a developer dispersion. The starting dispersions can be mixed and then be applied to a support material, for example to a plastic sheet or to paper, by means of a suitable device, for example a knife.

Binders and other additives can, if desired, be added to one, more than one or all of the starting dispersions or to the mixture of these dispersions. The procedure can also be such that individual starting dispersions or any desired mixtures different from one another of starting dispersions are applied in succession to a support material.

Application of individual or of all dispersions is followed by drying.

Thermoreactive recording materials according to the invention are preferably prepared as follows (parts are by weight):

a. Preparation of a chromogen dispersion 5 to 95 parts of one or more chromogens, preferably 20 to 75 parts, particularly preferably 40 to 60 parts, are stirred into 250 parts of an aqueous polyvinyl acetate solution comprising 0.1 to 30 parts, preferably 1 to 20 parts, particularly preferably 2 to 15 parts, of partially hydrolysed polyvinyl acetate and 92 parts of water, and the mixture is milled (for example using a sand mill) until the average particle size of the chromogen particles is 3 μm or less.

b. Preparation of a developer dispersion 1 to 50 parts of one or more colour developers, preferably 5 to 30 parts, particularly preferably 10 to 20 parts, and 10 to 100 parts of a sensitiser, preferably 20 to 80 parts, particularly preferably 35 to 60 parts, and 10 to 100 parts of one or more fillers, preferably 15 to 70 parts, particularly preferably 20 to 50 parts, are stirred into 272 parts of an aqueous polyvinyl acetate solution comprising 0.1 to 20 parts, preferably 1.5 to 10 parts, of partially hydrolysed polyvinyl acetate and 98 parts of water, and the mixture is milled (for example using a sand mill), until the average particle size of all solid particles is 3 μm or less.

c. Bisphenolcarboxylic acid salt dispersion 5 to 50 parts of one or more salts of modified bisphenolcarboxylic acids of the formula (I), preferably 10 to 45 parts, particularly preferably 20 to 35 parts, are stirred into 70 parts of an aqueous polyvinyl acetate solution comprising 0.1 to 30 parts, preferably 1 to 20 parts, particularly preferably 2 to 15 parts, of partially hydrolysed polyvinyl acetate and 66 parts of water, and the mixture is milled (for example using a sand mill) until the average particle size is 3 μm or less.

d. Preparation of a coating paint 120 to 40 parts, preferably 100 to 50 parts, particularly preferably 80 to 60 parts, of developer dispersion are stirred together with 20 to 0.5 parts, preferably 15 to 3 parts, particularly preferably 10 to 5 parts, of chromogen dispersion and 40 to 0.5 parts, preferably 30 to 5 parts, particularly preferably 20 to 10 parts of bisphenolcarboxylic acid salt dispersion, and the mixture is brought to a pH of 6 to 14, preferably 7 to 11, particularly preferably 7.5 to 9.5, with dilute sodium hydroxide solution.

e. Preparation of a thermoreactive recording material according to the invention The coating paint is applied to a paper surface by means of a wire-rod in an amount corresponding to a coating weight of 2 to 15 g/m$^2$, preferably 5 to 12 g/m$^2$, particularly preferably 7.5 to 10.5 g/m$^2$.

After drying, the coated paper is preferably calendered.

Thermoreactive recording materials according to the invention and not according to the invention were evaluated in the examples below by means of the following analytical methods:

a. Optical density

In a thermoprinter (Sharp CE 700 P), an area of 4×0.9 cm was printed fully black at maximum energy. The optical density of this measuring area was determined using a Macbeth Densitometer RD 917 (from Kollmorgen AG, Switzerland).

b Fat stability

First, the optical density was determined according to a. The printed area was then printed with a 20% by weight solution of castor oil in cyclohexane using a gravure printing machine (half-tone depth 150 #, from Gockel, Germany). After storing the printed paper at 60° C. for 3 hours, the optical density was again measured analogously to a. and the remaining intensity in per cent calculated as follows:

$$\text{\% of remaining intensity} = \frac{\text{optical density with fat} \times 100\%}{\text{optical density without fat}}$$

c. Plasticiser stability

The plasticiser stability was determined by first printing an area of 4×4 cm black in a thermoprinter (Sharp CE 700 p) at varying half-tone density in the printed area at maximum energy.

The absorption of this area was determined by means of an Elrepho 44 381 (from Carl Zeiss, Germany). The back of the printed area was placed on a steel plate, the printed area was covered with a PVC sheet containing 30% by weight of plasticiser (dioctyl phthalate) and loaded with a steel block 4×3×2.5 cm in size. This corresponded to a pressure of 20 g/cm$^2$.

After 24 hours' storage at 50° C., the absorption of the printed area was again determined, and the remaining intensity in per cent calculated as follows:

$$\text{\% absorption} = 100 \times \frac{\text{\% reflectance measured of the unprinted paper} - \text{\% reflectance measured of the printed paper}}{\text{\% reflectance measured of the unprinted paper}}$$

$$\text{\% remaining intensity} = \frac{\text{\% absorption after contact with the sheet} \times 100}{\text{\% absorption before contact with the sheet}}$$

d. Whiteness and storage stability

The whiteness was determined as % reflectance (a large value corresponds to high whiteness), and the undesired discoloration of the unprinted paper after storage at 60° C. was calculated as % absorption from reflectance (as described under c.) (a large value corresponds to dark paper).

e. Sensitivity

The sensitivity was determined by printing areas 5.5×0.8 cm in size each fully black at a top voltage of 26 V and variable pulse times using a thermoprinter testing device TP 104 (from Geminus, Germany). The optical density of these areas was determined by means of a Macbeth densitometer RD 917. The larger the differences in the optical densities at short and long pulse times, the more sensitive the thermopaper.

The salts of modified bisphenolcarboxylic acids to used according to the invention are also suitable as developers and/or additives in carbonless copying systems.

Recording materials according to the invention show ink stabilities and excellent stabilities to water, plasticisers, fats and substances contained in text-marking pens.

EXAMPLES

Below, parts and percentages are by weight and the amounts given are identical to amounts by weight.

Example 1: Preparation of a salt to be used according to the invention 33.6 g (0.4 mol) of sodium bicarbonate were initially introduced into 400 ml of water, and 97.7 g (0.4 mol) of 2,2-bis-(4-hydroxyphenyl)acetic acid were added in portions with stirring, and the mixture was stirred for a further 15 minutes. A solution of 27.2 g (0.2 mol) of zinc chloride in 100 ml of water was then added dropwise, and the mixture was heated to 90° C. After concentrating, the residue was dissolved in 100 ml of water, cooled and the precipitate formed was filtered off with suction, giving 78.1 g of the zinc salt of 2,2-bis-(4-hydroxyphenyl)-acetic acid.

Example 2: Preparation of a salt to be used according to the invention

A suspension of 85.9 g (0.3 mol) of 2,2-bis(4-hydroxy-3-methylphenyl)-propionic acid and 6.05 g (0.15 mol) of magnesium oxide in 400 ml of water was heated at 80° C. for 1 hour, resulting in dissolution of the reactants. After concentrating and cooling, 79.2 g of the magnesium salt of 2,2-bis(4-hydroxy-3-methylphenyl)-propionic acid were isolated.

Example 3: (Preparation of a recording material without bisphenolcarboxylic acid salt—not according to the invention)

50 g of 2-(2-chloroanilino)-6-dibutylamino-fluoran were stirred into 250 g of an 8% strength by weight polyvinyl acetate solution (prepared using Mowiol® 8/88). The coarse dispersion was then milled in a sand mill together with 1250 g of glass beads (1 mm in diameter) until the average particle size was 2.5 μm (→ dispersion 1). 14 g of bisphenol A, 42 g of benzenesulphanilide and 35 g of an acrylonitrile copolymer as filler were stirred into 272 g of a 2% strength by weight polyvinyl acetate solution (prepared from Mowiol® 8/88) and the mixture was milled as described above in a sand mill until an average particle size of 2.8 μm had been reached (→ dispersion 2). 72 parts of dispersion 2 and 7 parts of dispersion 1 were mixed together, the pH was brought to 9, and the surface of an untreated paper having a weight per unit area of 70 g/m$^2$ was coated by means of a wire-rod. The coating weight was 8.8 g/m$^2$. The untreated paper thus obtained was smoothed in a calender at a nip pressure of 80 kg/cm.

The measured results of the evaluation are shown in Tables 1 and 2.

Example 4: (Preparation of a recording material according to the invention)

Dispersions 1 and 2 were prepared as described in Example 3. 30 g of the Mg salt of 4,4-bis-(4-hydroxyphenyl)-pentanoic acid were stirred into 70 g of a 10% strength by weight polyvinyl acetate solution (prepared from Mowiol® 8/88), and the mixture was then milled as described Example 3 to an average particle size of 2.6 μm (→ dispersion 3). 72 parts of dispersion 2, 7 parts of dispersion 1 and 14 parts of dispersion 3 were mixed, the pH of the mixture was brought to 9 and the mixture was used for coating the surface of an untreated paper having a weight per unit area of 70 g/m$^2$ by means of a wire-rod. The coating weight was 10.1 g/m$^2$. Smoothing was carried out analogously to Example 3.

The measured results of the evaluation ar shown in Tables 1 and 2.

Example 5: (Preparation of a recording material without bisphenolcarboxylic acid salt—not according to the invention)

Example 3 was repeated. Before smoothing the coated paper, a second coating comprising a mixture of 100 parts of 10% strength by weight polyvinyl acetate solution (prepared from Mowiol® 4/98), 20 parts of calcium carbonate, 10 parts of a polyethylene wax emulsion (Lubaprint® 499, from L. P. Bader and Co. GmbH Chem. Fabrik, Rottweil, Germany) and 55 parts of water was applied.

The coating weight of the second layer was 6 g/m$^2$. Finally, smoothing was carried out analogously to Example 3.

The measured results of the evaluation are shown in Table 2.

Example 6: (Preparation of a recording material with bisphenolcarboxylic acid as additive—not according to the invention)

The preparation took place analogously to Example 4, except that dispersion 3 was prepared using the corresponding amount of bisphenolcarboxylic acid (instead of the magnesium salt from Example 4).

The measured results of the evaluation are shown in Table 1.

Example 7: (Preparation of a recording material according to the invention without developer)

The procedure of Example 3 was repeated, except that dispersion 2 was prepared by using the corresponding amount of the salt mentioned in Example 4 instead of bisphenol A.

The measured results of the evaluation are shown in Table 1.

Example 8: (Preparation of a recording material using the salt of a salicylic acid—not according to the invention)

The procedure of Example 4 was repeated, except that dispersion 3 was prepared using the corresponding amount of the zinc salt of 3-methylsalicylic acid instead of the Mg salt used in Example 4.

The measured results of the evaluation are shown in Table 1.

Examples 9 to 17: (Preparation of further recording materials according to the invention)

The preparation took place in each case analogously to Example 4, except that the salts listed in Table 3 of modified bisphenolcarboxylic acids of the formula (I) were used in the corresponding amount instead of the salt mentioned in Example 4.

The measured results of the evaluation are also shown in Table 3.

Example 18: (Preparation of a recording material using the ester of a bisphenolcarboxylic acid as additive—not according to the invention)

The preparation took place analogously to Example 4, except that the corresponding amount of methyl 4,4-bis(4-hydroxy-phenyl)-pentanoate was used instead of the Mg salt.

The measured results of the evaluation are shown in Table 1.

TABLE 1

| Example No. | Optical density | Fat stability | Plasticiser stability | Whiteness without exposure to oil | Whiteness with exposure to oil | Storage stability after 1 hour at 60° C. | Storage stability after 24 hours at 60° C. |
|---|---|---|---|---|---|---|---|
| 3 | 1.33 | 40.9% | 9.0% | 89.5% | 87.7% | 3.7% | 4.0% |
| 4 | 1.31 | 70.4% | 23.0% | 88.1% | 86.7% | 4.8% | 8.1% |
| 6 (comp.) | 1.29 | 89.2% | 36.0% | 70.6% | 55.3% | 39.4% | 60.2% |
| 7 | 1.20 | 75.4% | 38.0% | 83.2% | 80.1% | 6.1% | 10.2% |
| 8 (comp.) | 1.28 | 85.3% | 66.0% | 56.1% | 33.4% | 39.8% | 64.5% |
| 18 (comp.) | 1.30 | 70.9% | 5.1% | 84.4% | 42.1% | 70.7% | 74.4% |

Whiteness: the higher the % given, the whiter the paper
Storage stability: the higher the % given, the more extensive the undesired greying

TABLE 2

| Example No. | Optical density | Fat stability | Plasticiser stability | Sensitivity at 100 μsec of pulse time | Sensitivity at 260 μsec of pulse time | Sensitivity at 480*) μsec of pulse time |
|---|---|---|---|---|---|---|
| 3 (comp.) | 1.33 | 40.9% | 9.0% | 0.06 | 0.62 | 1.28 |
| 4 | 1.31 | 70.4% | 23.0% | 0.05 | 0.63 | 1.29 |
| 5 (comp.) | 1.07 | 55.4% | 15.0% | 0.04 | 0.24 | 0.73 |

*)see analytical method e.

TABLE 3

| Example No. | Salt used of a modified bishpenolcarboxylic acid with OH in the 4-position and with $R^1$ | $R^2$ | $R^3$ | m | n | M | Fat stability | Plasticiser stability | Storage stability |
|---|---|---|---|---|---|---|---|---|---|
| 9 | H | H | B**) | 1 | 0 | Mg | 53.8% | 15.8% | 6.1% |
| 10 | H | H | B | 1 | 0 | Ca | 57.1% | 19.3% | 7.3% |
| 11 | H | H | B | 1 | 0 | Zn | 76.1% | 35.9% | 13.2% |
| 12 | H | $CH_3$ | B | 1 | 0 | Mg | 59.1% | 19.9% | 5.9% |
| 13 | H | $CH_3$ | $CH_2$ | 1 | 0 | Mg | 63.6% | 34.9% | 7.5% |
| 14 | H | $CH_3$ | $(CH_2)_2$ | 1 | 0 | Ca | 58.2% | 27.3% | 7.2% |
| 15 | $CH_3$ ortho*) | $CH_3$ | B | 1 | 0 | Mg | 58.6% | 29.2% | 7.6% |
| 16 | $CH_3$ ortho*) | $CH_3$ | $(CH_2)_2$ | 1 | 0 | Zn | 95.3% | 87.4% | 23.2% |
| 17 | $CH_3$ ortho*) | $CH_3$ | $(CH_2)_3$ | 1 | 0 | Mg | 60.2% | 35.3% | 7.6% |

*)relative to OH
**)B is a direct bond

What is claimed is:

1. A thermoreactive recording material comprising a support coated with a coating comprising a chromogen, a color developer and at least one salt of a modified bisphenol carboxylic acid of the formula (I)

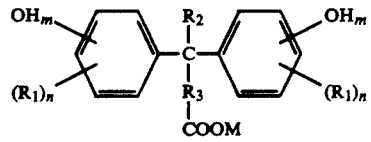

(I)

in which $R_1$ in each case represents, independently of one another, $C_1$-to $C_5$-alkoxy, $C_6$-alkyl, $C_3$- to $C_6$-cycloalkyl or phenyl, $R_2$ represents hydrogen, $C_1$- to $C_6$-alkyl or phenyl, $R_3$ represents $C_1$- to $C_5$-alkylene, m in each case represents, independently of one another, one or two, n in each case represents, independently of one another, zero, one or two and M represents an equivalent of a polyvalent metal ion.

2. A thermoreactive recording material of claim 1, in which in formula (I)

$R_1$ in each case represents, independently of one another, ethoxy, methoxy, i-propoxy, butoxy, pentoxy, methyl, ethyl, propyl, butyl, i-propyl, pentyl, cyclopropyl, cyclobutyl, cyclopentyl, cyclohexyl or phenyl, $R_2$ represents hydrogen, methyl, ethyl, propyl, butyl, 2-propyl, 1-pentyl, 2-pentyl, 1-hexyl, i-butyl or phenyl, $R_3$ represents methylene, 1,1-ethylene, 1,2-ethylene, 1,1-propylene, 1,2-propylene, 1,3-propylene, 2,2-propylene, 1,1-butylene, 1,2-butylene, 1,3-butylene, 1,4-butylene, 2,2-butylene, or 2,3-butylene.

3. A thermoreactive recording material of claim 1, in which the salts of modified bisphenolcarboxylic acids of the formula (I) have a symmetrical structure.

4. A thermoreactive recording material of claim 1, in which in formula (I)

$R_1$ represents methyl or tert.-butyl, $R_2$ represents hydrogen or methyl, 'R$_3$ represents $C_1$- to $C_3$-alkylene, m represents one, n represents zero or one and M represents an equivalent of $Mg^{2+}$, $Zn^{2+}$, $Ca^{2+}$ or $Pb^{2+}$.

5. A thermoreactive recording material of claim 1, which additionally contains one or more additives selected from the group consisting of sensitizers and binders on a support material.

6. A thermoreactive recording material of claim 5, in which the coating applied to a support material contains 0.1 to 40% by weight of said at least one salt of a modified bisphenol carboxylic acid of the formula (I), 1 to 20% by weight of said chromogen, 5 to 25% by weight of said color developer, 0 to 30% by weight of said sensitizers, 5 to 80% by weight of said binders, and the sum of the components of the coating adds up to 100% by weight.

7. A thermoreactive recording material of claim 1, wherein said support comprises paper, plastic sheets, paperboard or cardboard.

8. Process for the preparation of a thermoreactive recording material of claim 1, in which a chromogen dispersion, a dispersion containing at least one salt of a modified bisphenol carboxylic acid of the formula (I) and a developer dispersion are separately prepared and the dispersions are then applied individually in succession to a support material, followed by drying.

9. The process of claim 8, in which one or more additives selected from the group consisting of binders ad sensitizers are added to one or more of the dispersions.

10. Process for the preparation of a thermoreactive recording material of claim 1 in which a chromogen dispersion, a dispersion containing at least one salt of a modified bisphenol carboxylic acid of the formula (I) and a developer dispersion are mixed together and the resulting mixture is applied to a support material and dried.

* * * * *